United States Patent [19]

Nattrass

[11] Patent Number: 4,976,038

[45] Date of Patent: Dec. 11, 1990

[54] SHOTGUN SIGHTING SYSTEM AND METHOD

[76] Inventor: Floyd C. Nattrass, RR1 Okotoks, Alberta, Canada, T0L 1T0

[21] Appl. No.: 390,648

[22] Filed: Aug. 7, 1989

[51] Int. Cl.[5] ..... F41G 1/00

[52] U.S. Cl. ..... 33/233; 33/252; 42/100; 42/14

[58] Field of Search ..... 33/233, 234, 252–260; 42/100, 73, 74; 434/19

[56] References Cited

U.S. PATENT DOCUMENTS

| | | | |
|---|---|---|---|
| 433,323 | 7/1890 | Bunge | 42/100 |
| 953,696 | 4/1910 | Konig | 33/234 |
| 2,861,344 | 5/1957 | Moore | 33/233 |
| 4,017,995 | 4/1977 | Hughes, Jr. | 42/100 |
| 4,055,016 | 10/1977 | Katsenes | 42/73 |
| 4,122,623 | 10/1978 | Stice | 42/73 |
| 4,750,269 | 6/1988 | Townsend et al. | 33/234 |

FOREIGN PATENT DOCUMENTS

| | | | |
|---|---|---|---|
| 23637 | of 1897 | United Kingdom | 33/233 |
| 13218 | of 1911 | United Kingdom | 33/233 |

OTHER PUBLICATIONS

Roy Dunlap, *Gun Owner's Book of Care, Repair and Improvement,* 1974, Times Mirror Images, Inc., pp. 181–185.

Garry James, "1853 Enfield Rifle Musket", Guns & Ammo., Jun. 1989, p. 99.

Williams Gun Sight Company, "1964 Williams Products Catalog", 1964, pp. 1–40.

*Primary Examiner*—William A. Cuchlinski, Jr.
*Assistant Examiner*—Alvin Wirthlin
*Attorney, Agent, or Firm*—Thorpe, North & Western

[57] ABSTRACT

A sighting system for a shotgun useful for a user to align firing trajectory with a target. The system includes a sight rigidly fixed at a forward end of the shotgun barrel, and a rearward, transient sighting element which is utilized to establish concurrent sighting alignment on a single target for (i) a first line of sight coaxial with a shotgun bore and (ii) an adjustable, second line of sight defined by a line connecting the sighting bead of the forward sight and the aligned aperture of the rearward sighting element with the target. An adjustable comb is coupled to the stock of the shotgun and is raised to and locked at a proper height to define a contact reference location on the user's face. In this position, the shooter's eye is centered on the second line of sight and the transient sight element may be removed. Inter-changeable components permit selection of variable heights and sizes for both the forward sight, bead, blade and rearward sight element.

19 Claims, 4 Drawing Sheets

SHOTGUN SIGHTING SYSTEM AND METHOD

BACKGROUND OF THE INVENTION

1. Field of Invention:

This invention relates to devices and methods for orienting and aiming a shotgun with respect to a target. More particularly, the present invention pertains to aiming devices for a shotgun which are particularly helpful in trap shooting and field applications where target movement is sudden and rapid.

2. Prior Art:

The contrast between rifle shooting and using a shotgun may best be appreciated by contrasting conventional methods of sighting each weapon. Rifles are specifically designed for accuracy. With a rifle which has been properly sight-adjusted, proper firing alignment and elevation occur; when the front sight of the rifle is brought into alignment with a rear sight. The combination of front and rear sight establish the trajectory of the weapon to the target. Similarly, a rifle scope establishes the trajectory for the rifle, based on crosshairs within the scope.

In contrast, conventional shooting of a shotgun does not typically utilize front and rear sight alignment. Such technique is simply not useful because the shotgun is intended for use with rapidly moving targets such as skeet and birds encountered at close range. The shooter simply does not have time to align front and rear sights on the target. Such alignment is impeded by (i) the need to rapidly move the weapon to "catch up" with the moving target and (ii) the difficulty of maintaining the target in visual focus while visually keeping track of the sighting alignment. Therefore, proper alignment of the shotgun is a matter of estimating than actual sighting on the target.

Trap shooting perhaps best exemplifies conventional techniques for using a shotgun. An initial challenge faced by a shooter is to locate the target as it is ejected from ground level. In other words, the target or bird must be identified as it comes up from underneath the gun. Once the bird is located, the shooter must quickly swing the shotgun barrel into the proper trajectory, advance ahead of the bird and fire. Because this movement must be rapid, most shooters do not have the ability to maintain eye contact with the target and also visually focus on a small aiming bead such as is typically associated with the end of a shotgun barrel. One either sees the aiming bead and loses track of the bird or one keeps focus on the target and loses the visual connection with the sight itself. Therefore, the shooter attempts to establish his line of sight along the shotgun barrel before the bird is launched, and then move his whole upper body and line of sight to an estimated intercept with the target in its line of flight.

OBJECTS AND SUMMARY OF THE INVENTION

It is therefore an object of the present invention to provide a sighting device and method which enables the shooter to maintain visual contact with a sight element on the front end of the shotgun barrel while swinging the barrel through a rapid movement to catch up with the moving bird or other target.

It is a further object of the present invention to provide a device and method for using a variably sized front sight on the shotgun so that it may be positioned on the target for proper shooting alignment.

An additional object of this invention is to combine the benefits of barrel sighting as conventionally used with a shotgun, with the advantages of a front sight as is typically used in rifle shooting.

These and other objects are realized in a sighting system for a shotgun which enables alignment of firing trajectory with a target, wherein the system comprises a forward sight member rigidly fixed at the forward end of the shotgun barrel. This sight member includes (i) a base with means for attachment to the barrel and (ii) a sighting bead with a bead face configured to face the user during firing and (iii) an elevating blade interconnecting the sighting bead with the base and giving proper height and orientation to the bead face with respect to the shotgun barrel. The system further includes a rearward, transient sighting element which has an alignment aperture which enables concurrent sighting alignment with a single target for (i) a first line of sight for the shotgun bore and (ii) an adjustable, second line of sight defined by a line connecting the bead face of the forward sight member and the alignment aperture of the rearward sighting element with the target. The respective aperture and bead face have relative dimensions which enable the user to view the bead face within the perimeter of the sighting aperture, with the target in the background, to insure proper alignment of the adjustable line of sight. The bead face is sufficiently large to enable the shooter to retain visual contact therewith while seeing the background and target. The rearward sighting element comprises a vertical track coupled to a base support, the base support having means for attachment to a rearward section of a shotgun barrel. The sighting element includes the tracking member slidably disposed along the track and including the sighting aperture configured for transient use during alignment procedures with respect to the adjustable line of sight.

Also disclosed is a method for orienting the shotgun, utilizing the respective sight member and rearward sighting element. The first step involves aligning the shotgun in an alignment position with the bore of the shotgun barrel sighted on a distant target. The shotgun is maintained in this alignment position while an adjustable sighting element which is attached at a rearward section of the shotgun is adjusted to a specific, aligned vertical position. This aligned vertical position is colinear with a line of sight extending through a sighting bead on the forward sight member to the target. An adjustable comb coupled to the stock is raised and locked to a desired elevation to support the shooter's sighting eye at this second line of sight so that the sighter element can be removed. The shooter may now accurately fire the shotgun by sighting only on the forward sight member.

DETAILED DESCRIPTION OF THE INVENTION

Figure 1:
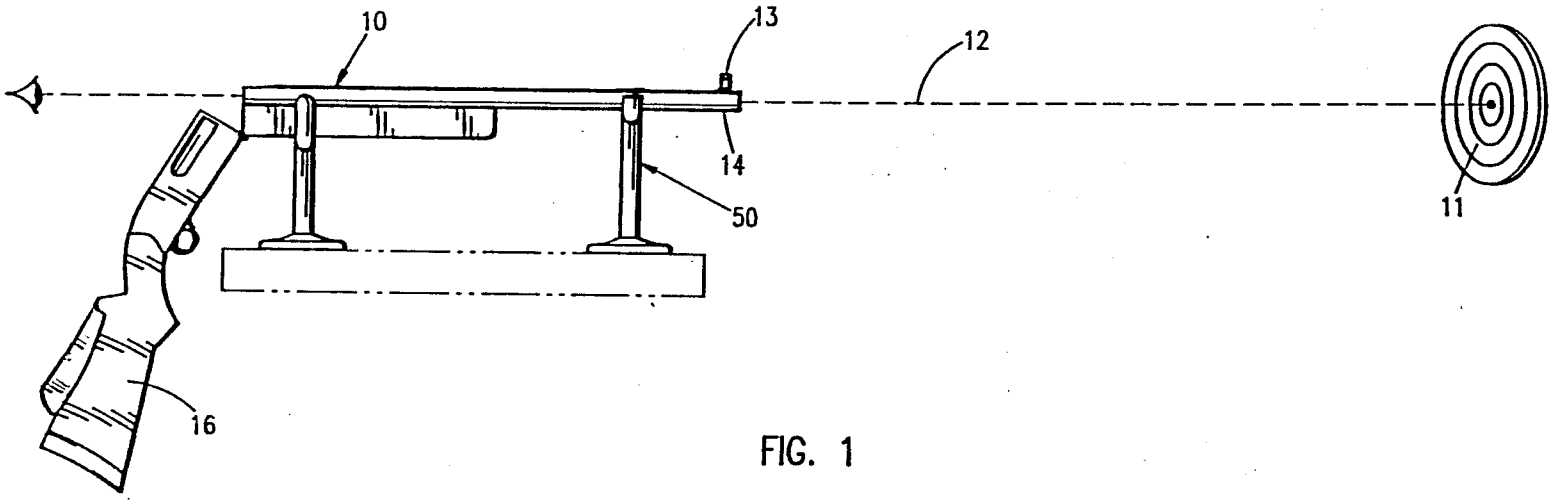
FIG. 1 shows a graphic representation of bore sighting procedures for a shotgun in accordance with the present invention.
Figure 2:
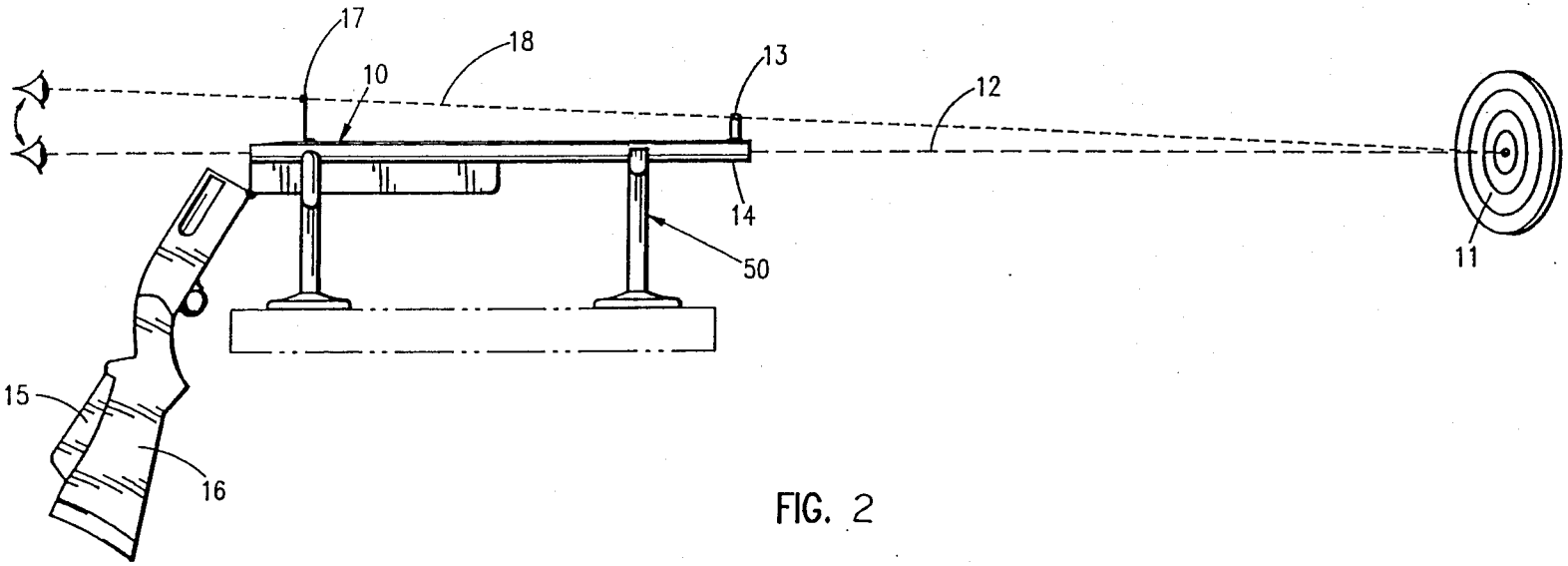
FIG. 2 graphically illustrates a procedure for orienting a shotgun on a second line of sight utilizing the inventive devices disclosed hereafter.
Figure 3:
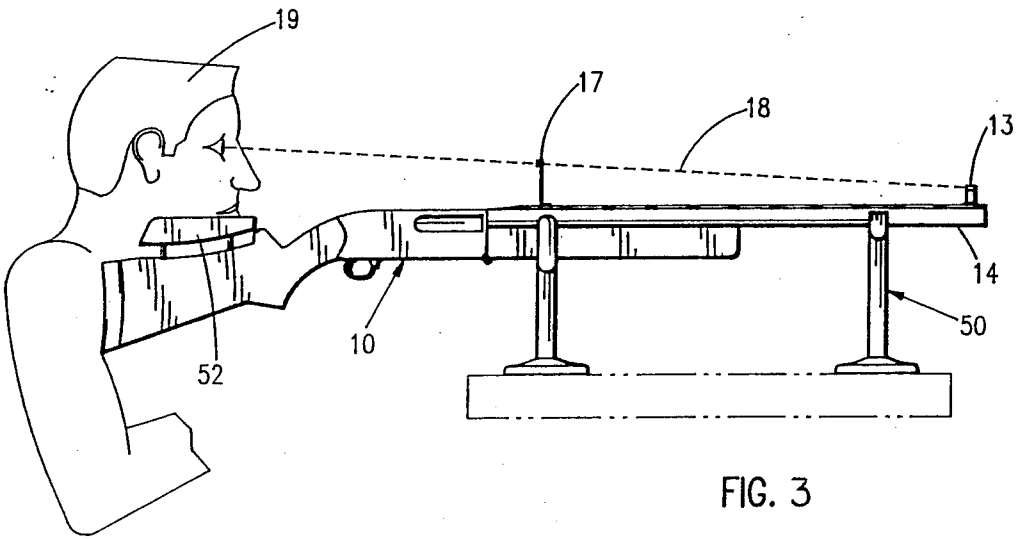
FIG. 3 illustrates vertical adjustment of the shotgun comb to align the shooter's eye with the pre-set second line-of-sight.

Referring now to the drawings:

FIGS. 1 through 3 illustrate procedural steps for preparing a shotgun 10 for accurate firing based on a novel system for sighting in the weapon. In overview, the system is practiced in three stages, corresponding to FIGS. 1, 2 and 3.

FIG. 1 illustrates the first step of bore sighting the barrel of the shotgun at some fixed point, such as a target 11. This target need not be of specific configuration, but could merely be a defined point at an appropriate distance such that the axis 12 of the barrel 14 can be aligned with the distant point (illustrated as the center of target 11). This step of bore sighting the shotgun is accomplished by merely looking down the barrel as is illustrated in FIG. 1, making any adjustments by shifting orientation of the shotgun barrel until the axis 12 of the bore intercepts the designated target. This axis 12 is referred to as the first line of sight or bore axis of the weapon. The object 11 intercepted by this axis 12 is the location where the projectile or shot pattern of the shotgun is designed to strike.

Once the proper orientation is established, the barrel is locked in place so that the alignment and first line of sight are not disturbed during the second stage of sighting alignment. Gripping devices 50 are used to lock the shotgun barrel in this desired orientation so that further steps can be applied without disturbing the first line cf sight 12 on the center of target 11. It will be apparent that many types of gripping devices are available, such as a conventional vice, which restrain the shotgun barrel against displacement in either horizontal or vertical directions.

With the shotgun properly bore sighted on the first line of sight 12, the weapon is prepared for the second stage of sighting alignment. This step involves use of a fixed, front sight member 13 and a rearward, adjustable sighting element 17. The front sight 13 remains fixed to the barrel and is utilized during actual firing of the weapon to aim at a selected target. The present invention incorporates a front sight of unique design which involves variable blade height and bead size which are selected for a specific application of the weapon. For example, the elevation and bead size of the front sight for trap shooting applications will differ from applications for slower moving targets. These variations will be discussed hereafter in connection with FIG. 4.

Once the front sight is selected, it is rigidly affixed to the barrel in a conventional manner as is shown in FIG. 1. This sight has been replaced in FIG. 2 with a blade of higher elevation to raise the bead with respect to the shotgun barrel. One advantage of the present invention is the ability of the shooter to change the front sight by substituting blades of differing elevation and beads of differing diameter.

Figure 4:
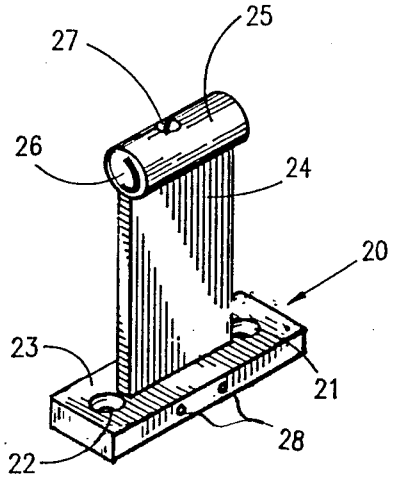
FIG. 4 shows a front sight member in perspective view.

FIG. 4 shows one embodiment of the forward sight member which facilitates such substitution of components. This forward sight member is adapted for rigid fixation to a forward end of the shotgun barrel by use of mounting screws through screw apertures 21 and 22. These apertures are positioned in the base 23 which provides a stable platform for enabling its rigid fixation to the shotgun barrel. For those shotguns having an aiming rib with a flat, upper surface, the sight member can be readily attached by screwing the base directly into the rib structure.

An elevating blade 24 is coupled to the base by solder or removable attachment means such as pins 28. This latter method of attachment enables substitution of differing blades of variable height. The pins are inserted through the base and seat within the blade body as illustrated as item 28 in FIG. 4. This enables a shooter to selected the blade of desired height and thereby adapt his weapon to specific field applications. Where a greater field of vision is desired or where targets are at shorter distances, blades of greater height would be preferred. In view of the principles disclosed herein, selection of specific blade heights will be apparent to those skilled in the art, based on each intended application. It will be noted generally that the blade height is significantly greater than prior art sight devices used with respect to the front end of shotgun barrels.

In addition to providing proper elevation to the sight bead 25, the blade gives proper orientation, positioning the blade face 26 toward the user, to facilitate visual detection during firing sequence. As has been previously noted, a major difficulty with trap shooting and general hunting of birds is the difficulty of maintaining visual connection with both the target and the aiming bead. It will be noted that the size of the sighting bead 25 and face 26 are large compared with prior art sighting devices. Generally, the bead face will be at least 3 millimeters in diameter and preferably be within the range of 5 to 12 millimeters in diameter. This large size enables rapid visual detection of the bead face and retention of the visual contact as visual detection of the moving bird or other target is accomplished.

The sighting bead 25 is also removable so that beads of differing size may be applied to the elevating blade 24. One of the operative principles in selecting bead face size is identification of the type of target and selection of a bead size sufficiently large to enable retention of visual contact with the sight along with concurrent detection of the target. This removable configuration is enabled by a screw 27 which seats with a corresponding screw opening (not shown) in the upper end of the blade 24. Based on experimentation, three practical sizes for bead dimensions are 6 millimeter, 9 millimeter and 12 millimeters in face width. If one were hunting for deer using a slug projectile, the preferable size for bead face would probably be approximately 6 millimeters because the target will be slow moving or stationary. If, however, the sport is skeet competition the bead diameter would likely be closer to 9 to 12 millimeters in size. This larger size enables the eye to quickly capture the required visual contact with the bead face 26 while at the same time searching for quick moving birds launched from the ground. In international competition, where the bird travels as much as 90 miles an hour, the larger bead face of approximately 12 millimeters may be necessary to enable immediate visual recognition of bird and sighting bead under extreme rapid movement.

Proper elevation for the bead will generally be at least one centimeter and perhaps as high as five centimeters, based on elevation characteristics already discussed. In addition to these previous factors, it should be noted that the higher elevation of blade gives more reaction time because it enables more rapid detection of a bird coming up from underneath the base of the sight. Limiting factors for height elevation of the blade will include the extent of comb adjustment available as will be described hereafter, as well as anticipated distance of the target from the shooter, practical heights for bead elevation are usually at least 1.0 cm, and more preferably 1.5 cm or 1.6 cm.

To assist in visual connection and retention of the bead face, differing colors may be used. A red or yellow bead face will help retain visual awareness while scanning for bird movement. Accordingly, both bead size and face color may be applied to enhance shooter reaction and accuracy in use of this sighting system.

Returning now to the sequence of aligning and configuring the shotgun with the present invention, reference is drawn to FIG. 2 which shows the shotgun 10 locked in a vice or other restraining means 50 with the first line of sight 12 properly oriented at the center of target 11. In this case, the target distance from the shotgun is illustrated at a very close range, when in fact the target distance is likely to be from 40 to 50 meters. It will therefore be apparent that the drawings are not to scale, but merely represent the concepts of establishing a second line of sight 18 which intercepts the first line of sight 12 at a designated target 11. The actual orientation of the second line of sight 18 is defined by the bead height in the sight member 13 and the target location as defined by the bore axis 12.

In other words, the second line of sight is established by drawing a line from the target 11 at the point of interception of the bore axis 12 to the bead face on sight member 13. This line of sight is then extended rearwardly as shown in FIG. 2 to determine where it intersects with the adjustable sighting element 17. This sighting element 17 provides means to fix the orientation of the second line of sight 18 between the sight member 13 and the rearward sighting element 17.

Figure 5:
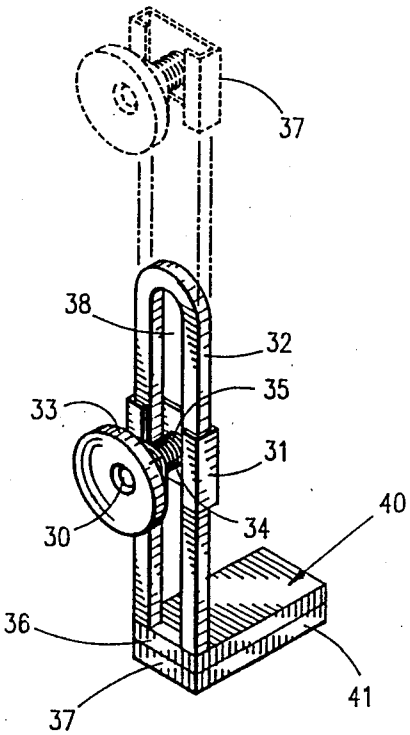
FIG. 5 shows a rear sighting element in perspective view.

This rearward sighting element includes an alignment aperture 30 (FIG. 5) which is designed for positioning on the extension of the second line of sight 18 as previously described. As will be discussed hereafter, this alignment aperture enables concurrent sighting alignment on a single target for (i) the first line of sight 12 for the shotgun bore, and (ii) an adjustable, second line of sight defined by a line connecting the bead of the forward sight member 13 and the alignment aperture 30 of the rearward sighting element with the target 11 on the bore sighting line 12. These elements are illustrated in greater detail in FIG. 5.

The alignment aperture 30 is formed as an annulus in an annular member 33. This annular member 33 includes a threaded extension 34 which fits within a threaded opening 35 in the vertical tracking member 31. The vertical tracking member 31 comprises a slidable carrier which is disposed along an upright track 32. This track provides a height to the tracking member above the barrel of at least 1 cm in the low position and at least 2.5 cm in the high position. The preferred height range for the track is approximately 12 mm to 5 cm. This combination permits the annular member 33 to be tightened by rotation into the threaded opening 35 within the tracking member, until the body of the annular member pulls the tracking member 31 into compression against the vertical track 32. In this manner, the alignment aperture 30 may be fixed at its appropriate vertical position along the second line of sight. If the annular member 33 is moved from the tracking member 31, the tracking member can be slid free from the vertical track 32 as is illustrated at item 37 in phantom line.

Removal of the slidable carrier and annular member from the vertical track 32 reveals the slotted opening 38 having side walls in approximate parallel relationship along its full length. When positioning the rearward sighting element on the barrel of the shotgun, the vertical track facilitates corrected vertical alignment by viewing the blade and bead of the forward sight member through the slotted opening 38. Correct alignment can be verified the forward blade 24 is approximately parallel with the side walls of the slotted opening 38. This procedure can be applied to confirm that the front sight has not been bent or tampered with.

The rearward sighting element is referred to herein as a transient sighting element because the structure is not intended for permanent attachment to the shotgun. Instead, the rearward sighting element is applied only during an alignment procedure represented by FIG. 2. This is accomplished by looking down the second line of sight 18 defined by the target 11 and bead 13 and adjusting the aperture opening to lie within this same line of sight. In other words, when the shooter can see the bead face 26 through the aperture 30 in centered relationship over the target 11, then the annular member is locked in place by rotation in the slidable carrier 31. At this point, the annular member and aperture are rigidly locked on the rearward sighting element such that the second line of sight is now captured by the relative orientation between the bead 13 and transient sighting element 17. The common target alignment of the first line of sight 12 and second line of sight 18 can be readily confirmed by simply viewing down the barrel to verify that the centered target on the first line of sight 12 is the same target point as is viewed through the aperture 30 and sight member 13. Once this is confirmed, the breach of the shotgun can be closed and final adjustments can be made as illustrated in FIG. 3.

These adjustments relate to configuring the shotgun with a contact reference point which is reproducible and which always places the shooter's aiming eye on the second line of sight 18. This step involves adjustment of a shotgun comb 52 to a desired elevation as is illustrated in FIG. 3. The comb 52 provides a contact reference point rigidly associated with the stock of the shotgun for positioning against the user's face such that later repositioning of the user's face at this reference point automatically places the user's eye on the second line of sight with the bead of the sight member 13.

Figure 6:
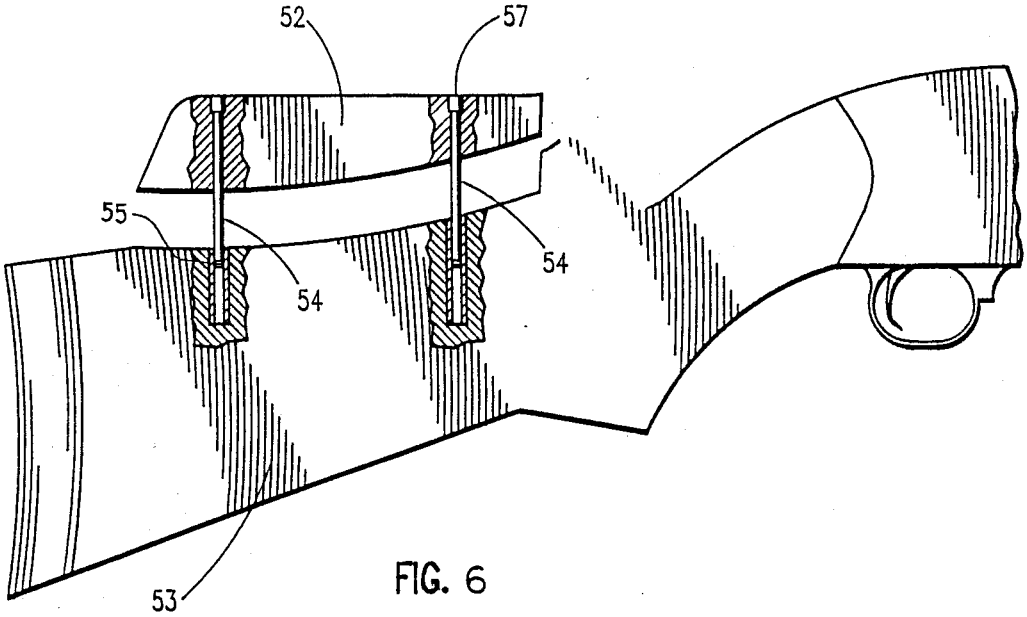
FIG. 6 illustrates a shotgun stock having an adjustable comb.
Figure 7:
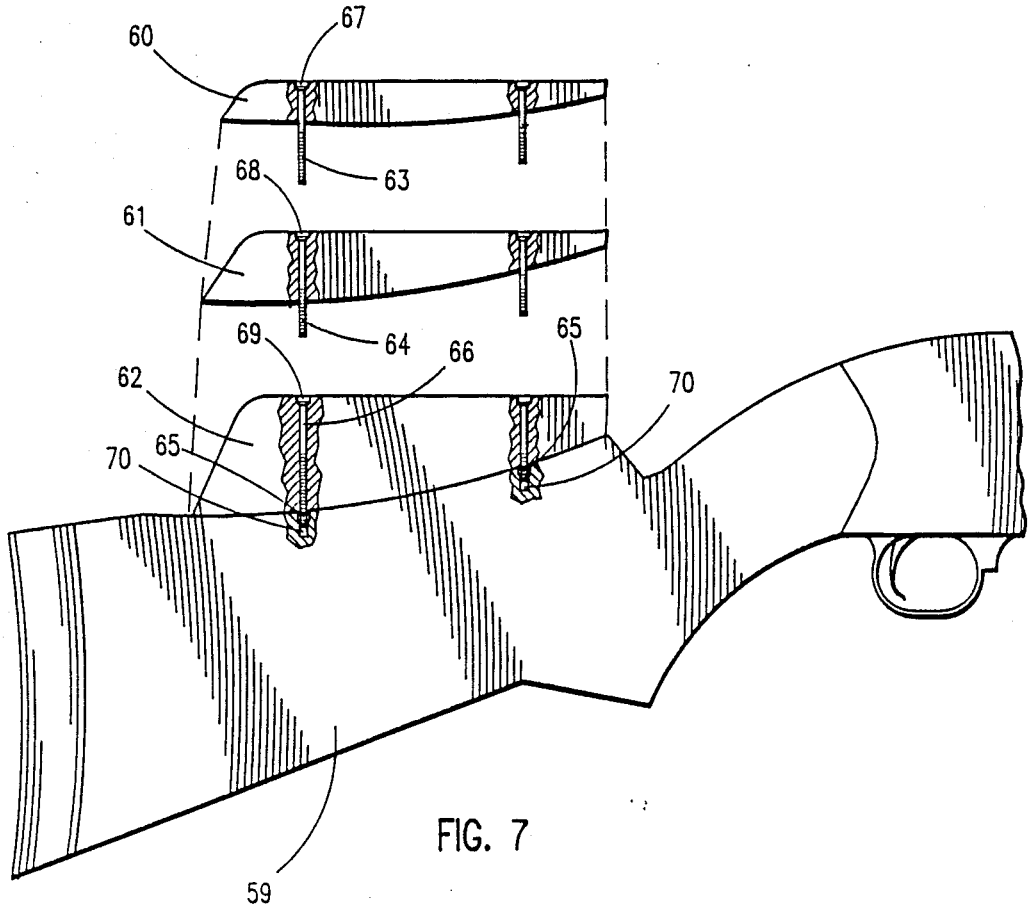
FIG. 7 discloses three comb inserts of varying size for use with the shotgun stock.

Conventional systems for providing height adjustment to the shotgun comb are well known. Accordingly, such adjustment techniques may be applied to the present invention for purposes of establishing the second line of sight with the user's aiming eye. FIGS. 6 and 7 illustrate improved structures and methods for enabling comb adjustment in accordance with the principles of the present invention. For example, FIG. 6 shows a single comb structure 52 coupled to the stock 53 of the shotgun by means of rods 54. These rods are rigidly mounted within the comb and extend vertically downward in alignment with mounting sleeves 55 which are counter sunk within the stock 53 and provide a receiving tube opening 57 for each rod 54. A set screw in the side of the stock (not shown) enables adjustment of the rods to variable elevations and locking of that elevation in fixed position with respect to the shotgun. This telescopic method of mounting the adjustable comb enables the shooter to easily and quickly raise or lower the comb to proper elevation to establish the contact reference point.

Returning to the procedural steps of properly aligning and configuring the shotgun under the present invention, a shooter uses the established second line of sight 18 to define the face position with respect to the weapon, and then raises or lowers the comb 52 to a comfortable fixed reference point on his face. It should be noted that the shooter no longer needs to make reference to a target or other object separate from the shotgun itself. In fact, the shooter merely needs to adjust the comb height so that his contact reference point enables his aiming eye to center the bead face of the sight member 13 within the aperture 30 of the sighting element 17. Once the shooter is confident that the contact reference point is correctly established with proper elevation of the comb 52, the sighting procedures have been completed. Repositioning of the shotgun at this contact reference point will automatically place the aiming eye on the second line of sight 18. The transient sighting element 17 may then be removed or otherwise displaced out of the second line of sight prior to firing of the shotgun. From this point forward, the shooter merely needs to place the bead face of the sight 13 on the target to properly sight the weapon firing.

It will be apparent that once the sight 13 and sighting element 17 have been properly aligned to establish the second line of sight 18, retaining the shotgun in a vice or other restricting device is unnecessary. Instead, the shooter merely needs to support the rifle to the extent necessary to allow adjustment of the comb to a proper contact reference position while maintaining his aiming eye on the second line of sight 18. This can be accomplished by supporting the shotgun on a convenient structure such as a tree, truck or even the forearm of the shooter. Accordingly, it is to be understood that the depiction of the gripping means 50 in FIG. 3 is not required for the third step of adjusting comb elevation at the contact reference point of the shooter's face. Indeed, the weapon can be support in any convenient manner as has been previously discussed.

Once the proper comb elevation is set and the shooter has established a comfortable and reproducible position with respect to the weapon and second line of sight 18 as now defined by the sight member 13 and sighting element 17, the sighting element can be displaced out of the line of sight or otherwise removed. From this point forward, the second line of sight 18 is established by the shooter repositioning his face at the contact reference point, thereby placing his aiming eye on the second line of sight. The shooter need only place the face of the bead for the sight member 13 on the intended target to know that the weapon is properly aimed.

Because the rearward sighting element 17 is not used during actual firing of the weapon, it may be constructed to be removable and is therefore referred to as the transient sighting element. Removable attachment of this element is accomplished by means of a base support 40 (FIG. 5) to which the vertical track 32 is permanently attached. This base support includes means 41 for attachment at a rearward section of the shotgun barrel and preferably at a flat surface of the rib attached thereto. A preferred embodiment of the present invention includes use of a magnet as the means for attachment 41. This magnet needs sufficient strength to provide secure fixation during the procedures which have been previously described. Once these procedures are completed, the transient sighting element is simply pulled free from the shotgun rib or other mounting surface An advantage of this removable configuration is that the shooter can later reconfirm the accuracy of his sight and comb elevation by simply replacing the transient sighting element magnetically to the top of the shotgun rib. As soon as the alignment is confirmed, the shooter can simply pull the sighting element free from the shotgun and resume his shooting activity.

It is important to note that the transient sighting element is not a sight in the traditional sense of that term. This will be apparent to those skilled in the art because the sighting element is not utilized during firing sequence, but is only applied during weapon alignment procedures as previously described. It will also be apparent that the sighting element can be simply rotated out of position or removed, depending upon the adopted configuration of attachment. The magnetic embodiment disclosed herein is merely one example of a convenient form of attachment for this transient sighting element.

The advantages of the inventive method and devices are numerous. To begin with, by following these procedures, a shotgun can be properly sighted and ready for shooting at clay targets or live game without actually firing a shot to confirm the sighting process. This is so because the first line of sight or bore axis of the weapon 12 represents the actual firing trajectory of the shotgun load, at least up to approximately 40 to 50 meters. The present method and device for establishing the second line of sight to intersect at the bore axis at the intended target distance enables the shooter to pre-sight his weapon without actually firing a shot. This not only enhances convenience for the user, but reduces expense by saving ammunition for actual hunting or game purposes, as opposed to sighting and alignment. This is in direct contrast to rifle sighting which generally requires the user to fire practice rounds of ammunition to confirm correct sight elevations and alignment. As long as the shotgun is firing at targets within less than 50 meters, the present system enables immediate firing without using any ammunition to confirm elevation or alignment settings.

The present inventive methods and devices are particularly useful for skeet and trap shooting. With the enlarged front bead face, the user can retain visual connection with the forward sight member. With peripheral vision, the target is visually located as it is launched and the shooter merely brings the bead face in alignment with the target or slightly in advance when he fires. The present invention allows substantial increase in accuracy for both expert and beginner and represents a significant step forward in shotgun shooting technique.

It will be apparent from the foregoing description that other embodiments or elements of the disclosed invention may be envisioned. For example, FIG. 7 illustrates the use of three differing comb attachments 60, 61 and 62 which may be alternately selected by the shooter, depending upon the height of the front sight member selected and the intended shooting distance. This system provides a more economical approach to comb adjustment than the more expensive continuously adjustable device shown in FIG. 6. In contrast, FIG. 7 provides a plurality of comb structures 60, 61 and 62 which each have a contoured base which matches the upper surface of the user's shotgun. Openings 70 are drilled into the stock to a sufficient depth to allow the mounting screws 63, 64 and 66 to be inserted within countersunk nuts 65 positioned at the top of the openings 70.

To use the set of multiple combs illustrated in FIG. 7, the user selects that comb suited to the selected sight member 13 and shooting distance. The shooter then mounts the comb by positioning the screws over the nuts 65 and rotating each screw at a slotted opening 67, 68 or 69 to rigidly fix the comb in its proper oriented position at the top of the stock. It will be apparent that screw lengths may be adjusted to ensure that the comb is properly seated and secured in fixed position.

Upon changing a sight member to a different elevation, the shooter may simply replace the comb with one of corresponding elevation. Final adjustment of contact reference point with respect to the plurality of combs shown in FIG. 7 is done by the actual carving of comb structure from the upper surface. The user applies the same techniques previously illustrated with respect to the adjustable comb 52, but makes final adjustment of comb height by carving away material to reach the exact desired elevation, rather than making fine adjustments by shifting the rods 54 within the adjustment sleeves 55.

Accordingly, it is to be understood that the scope of the invention is not to be limited by the foregoing description, but is defined in the following claims.

I claim:

1. A sighting system for a shotgun useful for a user to align firing trajectory with a target, said sighting system comprising:

a facial contact support point;

a forward sight member for rigid fixation at a forward end of a shotgun barrel, said sight member comprising (i) a base with means for attachment to the barrel, (ii) a sighting bead with a bead face configured to face the user during firing, and (iii) an elevating blade interconnecting the sighting bead with the base and giving proper height and orientation to the bead face with respect to the shotgun barrel;

a rearward, transient sighting element having an alignment aperture enabling concurrent sighting alignment on a single target for (i) a first line-of-sight for the shotgun bore and (ii) an adjustable non-parallel second line-of-sight defined by a line connecting the bead of the forward sight member and the alignment aperture of the rearward sighting element with the target;

said aperture and bead face having relative dimensions which enable the user to view the bad face through and within the sighting aperture, with the target in background, to ensure proper alignment of the adjustable line of sight;

said rearward sighting element comprising a vertical track coupled to a base support, said support having means for attachment to a rearward section of the shotgun barrel, said sighting element including a tracking member slidably disposed along the track and including the sighting aperture configured for transient use during alignment procedures with respect to the adjustable line-of-sight; and displacement means coupled to the rearward sighting element for enabling displacement or removal of the alignment aperture out of the second line of sight prior to firing of the shotgun, such that no rear sighting element is aligned on the second line of sight.

2. A sighting system as defined in claim 1, wherein the base support of the rearward sighting element includes means for removable attachment with respect to the rearward section of the barrel to enable removal of the sighting element when alignment procedures are completed.

3. A sighting system as defined in claim 2, wherein the means for removable attachment comprises a magnet of sufficient strength to provide secure fixation during alignment procedures.

4. A sighting system as defined in claim 1, wherein the vertical track of the rearward sighting element includes a vertical, slotted opening configured to be in parallel relationship with respect to the forward elevating blade to facilitate visual confirmation of correct alignment of the rearward sighting element with the forward fixed sight member.

5. A sighting system as defined in claim 4, wherein the slotted opening is centrally disposed along a vertical axis of the vertical track and configured to permit the user to view the forward sight member within the track.

6. A sighting system as defined in claim 1, wherein the bead face is at least 3 mm in diameter.

7. A sighting system as defined in claim 1, wherein the bead face is elevated above the barrel at a height of at least 16 mm and the sighting element includes the track of claim 1 having a height above the barrel of at least approximately 12 mm in low position and 5 cm in high position.

8. A sighting system as defined in claim 1, wherein the bead face is elevated above the barrel at a height of at least one centimeter and the sighting element includes the track of claim 1 having a height above the barrel of at least 1 cm at low position and at least 2.5 cm at high position.

9. A sighting system as defined in claim 1, wherein the bead face is elevated above the barrel at a height of at least 1.5 centimeters and the sighting element includes the track of claim 1 having a height above the barrel in high position of approximately 5 cm.

10. A sighting system as defined in claim 1, wherein the tracking member comprises (i) an annular member with a threaded exterior surface and open annulus providing the sighting aperture, and (ii) a slidable carrier suspended on the track and having a threaded opening for receiving the exterior threaded surface of the annular member, said annular member and carrier being interconnected to enable tightening of the tracking member at a fixed position on the track.

11. A sighting system as defined in claim 1, wherein said facial contact support point comprises a plurality of comb extensions for attachment to the stock of a shotgun, each comb extension having a different extension height and including means for attachment to the stock.

12. A sighting system as defined in claim 1, wherein said facial contact support point comprises a single comb extension and a plurality of rods for interconnecting a comb to the stock of the shotgun, each rod having means at one end for adjustable attachment to the stock of the shotgun and means at a remaining end for attachment to the comb.

13. A rearward, transient sighting element for use as part of a sighting system for a shotgun enabling a user to align firing trajectory of the shotgun with a target, said sighting element comprising:

a base support with means for temporary attachment thereof with respect to a rearward section of a shotgun barrel;

a vertical track coupled to the base support; and a tracking member including an alignment aperture which enables concurrent sighting alignment on a single target for (i) a first line of sight oriented through the bore of the shotgun and (ii) an adjustable, non-parallel second line of sight defined by a line connecting a sight bead located at the end of the shotgun barrel and the alignment aperture of the rearward sighting element on a single, given target;

said alignment aperture having relative dimensions which enable the user to view the sighting bead through and within the perimeter of the alignment aperture, with the target in background, to ensure proper alignment of the adjustable line of sight; and displacement means coupled to the rearward sighting element for enabling displacement or removal of the alignment aperture out of the second line of sight prior to firing the shotgun, such that no rear sighting element is aligned on the second line of sight.

14. A rearward sighting element as defined in claim 13, wherein the means for removable attachment of the base support comprises a magnet of sufficient strength to provide secure fixation of the rearward sighting element during alignment procedures.

15. A rearward sighting element as defined in claim 13, wherein the vertical track includes a vertical, slotted opening centrally disposed along a vertical axis of the vertical track.

16. A rearward sighting element as defined in claim 15, wherein the tracking member comprises (i) an annular member with threaded exterior surface and open annulus providing the sighting aperture, and (ii) a slidable carrier suspended on the track and having a threaded opening for receiving the exterior threaded surface of the annular member, said annular member and carrier being interconnected to enable tightening of the tracking member at a fixed position on the track.

17. A shotgun having an improved sighting system useful for aligning firing trajectory with a target in a manner comparable to a rifle sighting system, and wherein the shotgun includes an adjustable comb extending from the shotgun stock for providing a facial contact support point, the improvement comprising:

a forward sight member rigidly affixed to a forward end of the shotgun barrel and including (i) a sighting bead with a bead face configured to face the user during firing, and (ii) an elevating blade interconnecting the sighting bead with the shotgun barrel and giving proper height and orientation to the bead face with respect to the barrel;

a rearward transient sighting element having an alignment aperture adjusted for concurrent sighting alignment on a single target for (i) a first line-of-sight for the shotgun bore and (ii) an adjustable non-parallel second line-of-sight defined by a line connecting the bead of the forward sight member and the alignment aperture of the rearward sighting element with the target;

said aperture and bead face having relative dimensions which enable the user to view the bead face through and within the perimeter of the aperture, with the target in background, to ensure proper alignment of the adjustable line of sight;

said rearward sighting element comprising a vertical track coupled to a base support, said support having means for attachment to a rearward section of the shotgun barrel, said sighting element including a tracking member slidably disposed along the track and including the sighting aperture configured for transient use during alignment procedures with respect to the adjustable line-of-sight; and displacement means coupled to the rearward sighting element for enabling displacement or removal of the alignment aperture out of the second line of sight prior to firing the shotgun, such that no rear sighting element is aligned on the second line of sight.

18. A shotgun as defined in claim 15, wherein the base support of the rearward sighting element includes means for mobile attachment with respect to the rearward section of the barrel to enable removal of the sighting element from the second line of sight when alignment procedures are completed.

19. A method of orienting and aiming a shotgun having a forward sight bead with respect to a target, said method comprising the steps of:

aligning the shotgun in an alignment position with the bore of the shotgun barrel sighted on a distant target, forming a first line-of-sight;

attaching an adjustable sighting element having a sighting aperture in an upright position at a top surface of a rearward section of the shotgun such that the sighting aperture is capable of adjustment along a vertical plane of the shotgun and with respect to the top surface of the barrel;

adjusting the sighting aperture to an aligned vertical position while maintaining the alignment position of the bore on the sighted target, said aligned vertical position being collinear with a second non-parallel line-of-sight extending from a sighting eye of a user, through the sight bead near the front end of the barrel and to the target;

identifying a contact reference point associated with the stock of the shotgun for positioning against a user's face such that re-positioning the user's face at the contact reference point automatically places the sighting aperture and sighting bead on the line-of-sight with the user's sighting eye; and displacing the sighting aperture out of the second line prior to firing the shotgun, such that no rear sighting element is aligned on the second line of sight.

* * * * *